US008319713B2

(12) United States Patent
Choi

(10) Patent No.: US 8,319,713 B2
(45) Date of Patent: Nov. 27, 2012

(54) PIXEL AND ORGANIC LIGHT EMITTING DISPLAY USING THE SAME

(75) Inventor: Sang-Moo Choi, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 842 days.

(21) Appl. No.: 12/364,679

(22) Filed: Feb. 3, 2009

(65) Prior Publication Data

US 2009/0243976 A1 Oct. 1, 2009

(30) Foreign Application Priority Data

Mar. 26, 2008 (KR) ..... 10-2008-0027903

(51) Int. Cl.
*G09G 3/30* (2006.01)

(52) U.S. Cl. ..... 345/78; 345/76; 345/82

(58) Field of Classification Search ..... None
See application file for complete search history.

(56) References Cited

U.S. PATENT DOCUMENTS

2007/0236430 A1* 10/2007 Fish ..... 345/82
2008/0111804 A1* 5/2008 Choi et al. ..... 345/205

FOREIGN PATENT DOCUMENTS

JP 2006-284916 10/2006
JP 2007-206590 8/2007
KR 10-2005-0116206 12/2005
KR 10-2007-0012979 1/2007
KR 10-0815756 3/2008

OTHER PUBLICATIONS

Korean Office action dated Jun. 12, 2009, for priority Korean application 10-2008-0027903.

* cited by examiner

*Primary Examiner* — Joseph Haley
(74) *Attorney, Agent, or Firm* — Christie, Parker & Hale, LLP

(57) ABSTRACT

A pixel capable of compensating for deterioration of an organic light emitting diode includes an organic light emitting diode. A pixel circuit includes a first transistor controlling an amount of current supplied from a first power supply to the organic light emitting diode corresponding to a data signal. A compensating unit controls a voltage of a gate electrode of the first transistor to compensate for deterioration of the organic light emitting diode. The compensating unit includes a second transistor coupled between the gate electrode of the first transistor and the organic light emitting diode and turned off during a period of the supply of the data signal to the pixel circuit, and a feedback capacitor coupled between the second transistor and the organic light emitting diode.

17 Claims, 7 Drawing Sheets

PIXEL AND ORGANIC LIGHT EMITTING DISPLAY USING THE SAME

CROSS-REFERENCE TO RELATED APPLICATIONS

This application claims priority to and the benefit of Korean Patent Application No. 10-2008-00027903, filed on Mar. 26, 2008, in the Korean Intellectual Property Office, the entire content of which is incorporated herein by reference.

BACKGROUND OF THE INVENTION

1. Field of the Invention

The present invention relates to a pixel and an organic light emitting display using the same, and particularly a pixel and an organic light emitting display using the same capable of compensating for deterioration of an organic light emitting diode.

2. Description of Related Art

Recently, various flat panel display devices capable of reducing weight and volume, which are unfavorable in a cathode ray tube, have been developed. Flat panel display devices can include: liquid crystal displays (LCDs), field emission displays (FEDs), plasma display panels (PDPs) and organic light emitting display (OLEDs).

Among the flat panel display devices, the OLED displays an image using an organic light emitting diode generating light by recombination of electrons and holes. Such an organic light emitting display has advantages in that it has a rapid response speed while being driven with low power consumption.

FIG. 1 is a circuit diagram showing a pixel of a conventional organic light emitting display disclosed in Korean Patent Registration No. 10-0815756.

Referring to FIG. 1, the pixel 4 of the conventional organic light emitting display includes an organic light emitting diode OLED, and a pixel circuit 2 coupled to a data line Dm and a scan line SN to control the organic light emitting diode OLED.

An anode electrode of the organic light emitting diode OLED is coupled to the pixel circuit 2, and a cathode electrode thereof is coupled to a second power supply ELVSS. Such an organic light emitting diode OLED generates light having a predetermined brightness corresponding to current supplied from the pixel circuit 2.

The pixel circuit 2 controls current amount supplied to the organic light emitting diode OLED corresponding to a data signal supplied to the data line Dm when a scan signal is supplied to the scan line Sn. To this end, the pixel circuit 2 includes a transistor M1, a transistor M2, and a storage capacitor Cst. The transistor M2 is coupled between a first power supply ELVDD and the organic light emitting diode OLED. The transistor M1 is coupled between the transistor M2, the data line Dm, and the scan line Sn. Also, the storage capacitor Cst is coupled between a gate electrode and a first electrode of the transistor M2.

A gate electrode of the transistor M1 is coupled to the scan line Sn, and a first electrode thereof is coupled to the data line Dm. A second electrode of the transistor M1 is coupled to one side terminal of the storage capacitor Cst. Herein, the first electrode is set to any one of a source electrode and a drain electrode, and the second electrode is set to the other electrode different from the first electrode. For example, if the first electrode is set to the source electrode, the second electrode is set to the drain electrode. When the scan signal is supplied from the scan line Sn, the transistor M1 coupled to the scan line Sn and the data line Dm is turned on to supply the data signal supplied from the data line Dm to the storage capacitor Cst. At this time, the storage capacitor Cst is charged with a voltage corresponding to the data signal.

The gate electrode of the transistor M2 is coupled to one side terminal of the storage capacitor Cst, and the first electrode thereof is coupled to the other side terminal of the storage capacitor and the first power supply EVLDD. A second electrode of the transistor M2 is coupled to the anode electrode of the organic light emitting diode OLED. Such a transistor M2 controls the amount of current flowing from the first power supply ELVDD to the second power supply ELVSS via the organic light emitting diode OLED corresponding to a voltage value stored in the storage capacitor Cst. The organic light emitting diode OLED then generates light corresponding to the current amount supplied from the transistor M2.

However, such a conventional organic light emitting display has a problem in that it becomes impossible to display an image having a desired brightness due to an efficiency change as a result of a deterioration of the organic light emitting diode OLED. In other words, as the organic light emitting diode deteriorates over time it is becomes impossible to display the image in the desired brightness. In essence, as the organic light emitting diode deteriorates, light having a low brightness is generated.

SUMMARY OF THE INVENTION

In accordance with the present invention a pixel and an organic light emitting display using the same is provided capable of compensating for deterioration of an organic light emitting diode.

A pixel according to an embodiment of the present invention includes an organic light emitting diode. A pixel circuit includes a first transistor controlling an amount of current supplied from a first power supply to the organic light emitting diode corresponding to a data signal. A compensating unit controls a voltage of a gate electrode of the first transistor to compensate for deterioration of the organic light emitting diode. The compensating unit includes a second transistor coupled between the gate electrode of the first transistor and the organic light emitting diode and turned off during a period of a supply of the data signal to the pixel circuit and a feedback capacitor coupled between the second transistor and the organic light emitting diode.

Exemplarily, the compensating unit further includes a third transistor coupled between a common terminal of the second transistor and the feedback capacitor and an initialization power supply. The third transistor maintains a turn-on state during the period of the supply of the data signal to the pixel circuit. The initialization power supply is set to the same value as the first power supply.

A pixel according to another embodiment of the present invention includes an organic light emitting diode. A pixel circuit includes a first transistor controlling an amount of current supplied from a first power supply to the organic light emitting diode corresponding to a data signal. A compensating unit controls a voltage of a gate electrode of the first transistor to compensate for deterioration of the organic light emitting diode. The compensating unit includes a second transistor coupled between the gate electrode of the first transistor and the organic light emitting diode and maintains a turn-on state during a period of the supply of the data signal to the pixel circuit and a feedback capacitor coupled between the second transistor and the organic light emitting diode.

Exemplarily, the second transistor is turned off during a period equal to or longer than the period of the supply of the data signal after the data signal is supplied.

An organic light emitting display according to an embodiment of the present invention includes a scan driver sequentially supplying scan signals to scan lines and sequentially supplying first control signals to first control lines. A data driver supplies data signals to data lines. A power supply signal supplier sequentially supplies power supply signals to power supply lines. Pixels are positioned at intersection points of the scan lines and the data lines. Each of the pixels positioned at an $i^{th}$ (i is a natural number) horizontal line includes: an organic light emitting diode; a pixel circuit including a first transistor controlling an amount of current supplied from a first power supply to the organic light emitting diode; and a compensating unit including a second transistor coupled between a gate electrode of the first transistor and the organic light emitting diode and turned off during a period of a supply of the scan signal to an $i^{th}$ scan line, and a feedback capacitor coupled between the second transistor and the organic light emitting diode.

Exemplarily, the scan driver supplies the first control signal to an $i^{th}$ first control line to overlap with the scan signal supplied to the $i^{th}$ scan line and at the same time, have a width wider than that of the scan signal. The second transistor is turned off when the first control signal is supplied.

An organic light emitting display according to yet another embodiment of the present invention includes a scan driver sequentially supplying scan signals to scan lines and sequentially supplying first control signals to first control lines. A data driver supplies data signals to data lines. Pixels are positioned at intersection points of the scan lines and the data lines. Each of the pixels positioned at an $i^{th}$ (i is a natural number) horizontal line includes: an organic light emitting diode; a pixel circuit including a first transistor controlling an amount of current supplied from a first power supply to the organic light emitting diode; and a compensating unit including a second transistor coupled between a gate electrode of the first transistor and the organic light emitting diode and maintaining a turn-on state during a period of the supply of the scan signal to an $i^{th}$ scan line, and a feedback capacitor coupled between the second transistor and the organic light emitting diode.

Exemplarily, after the scan signal is supplied to the $i^{th}$ scan line, the scan driver supplies the first control signal at a width equal to or wider than the scan signal to the $i^{th}$ first control line. The second transistor is turned off when the first control signal is supplied.

With the pixel and the organic light emitting display according to the present invention, as an organic light emitting diode deteriorates, current amount supplied from a driving transistor increases, making it possible to compensate for deterioration of the organic light emitting diode. Therefore, in accordance with the present invention, it is possible to display an image in a desired brightness, regardless of the deterioration of the organic light emitting diode.

DETAILED DESCRIPTION

Hereinafter, when a first element is described as being coupled to a second element, the first elements may be not only directly coupled to the second element but may also be indirectly coupled to the second element via a third element. Further, some of the elements that are not essential to the complete understanding of the invention are omitted for clarity. Also, like reference numbers refer to like elements throughout.

Figure 1:
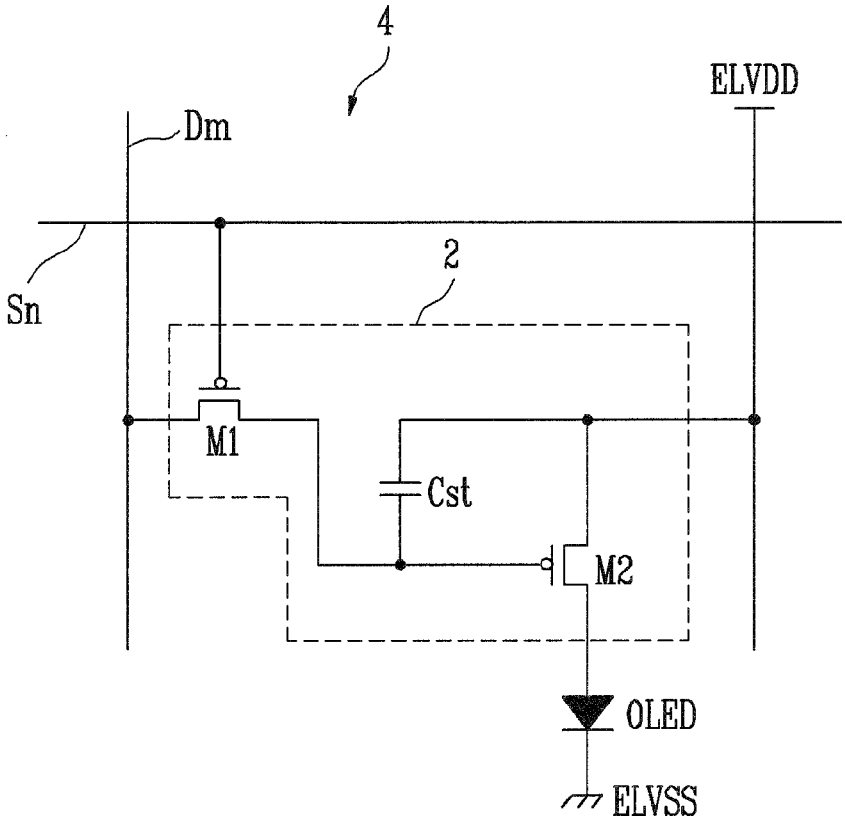
FIG. 1 (PRIOR ART)
FIG. 1 is a circuit diagram showing a pixel of a conventional organic light emitting display.
Figure 2:
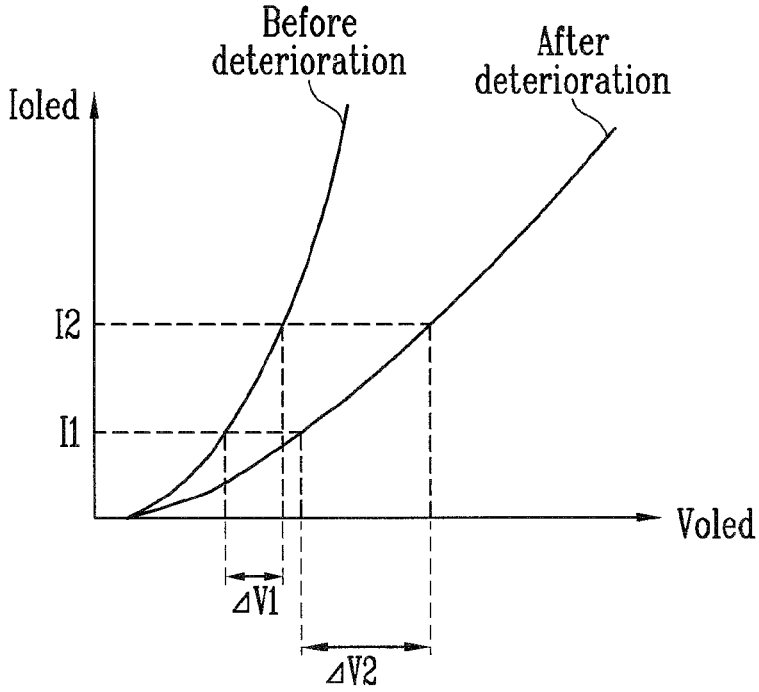
FIG. 2 is a graph showing deterioration characteristics of an organic light emitting diode.

FIG. 2 a graph showing deterioration characteristics of an organic light emitting diode. In FIG. 2, Ioled indicates current flowing to the organic light emitting diode, and Voled indicates voltage applied to the organic light emitting diode.

Referring to FIG. 2, as the organic light emitting diode deteriorates, a higher voltage is applied to the organic light emitting diode with respect to the same current. Before the organic light emitting diode deteriorates, voltage differential $\Delta V1$ is changed corresponding to a change of a specific current range I1 to I2. However, after the organic light emitting diode deteriorates, voltage differential $\Delta V2$ higher than the $\Delta V1$ is changed corresponding to the change of the specific current range I1 to I2. As the organic light emitting diode deteriorates, the resistance component of the organic light emitting diode increases.

Figure 3:
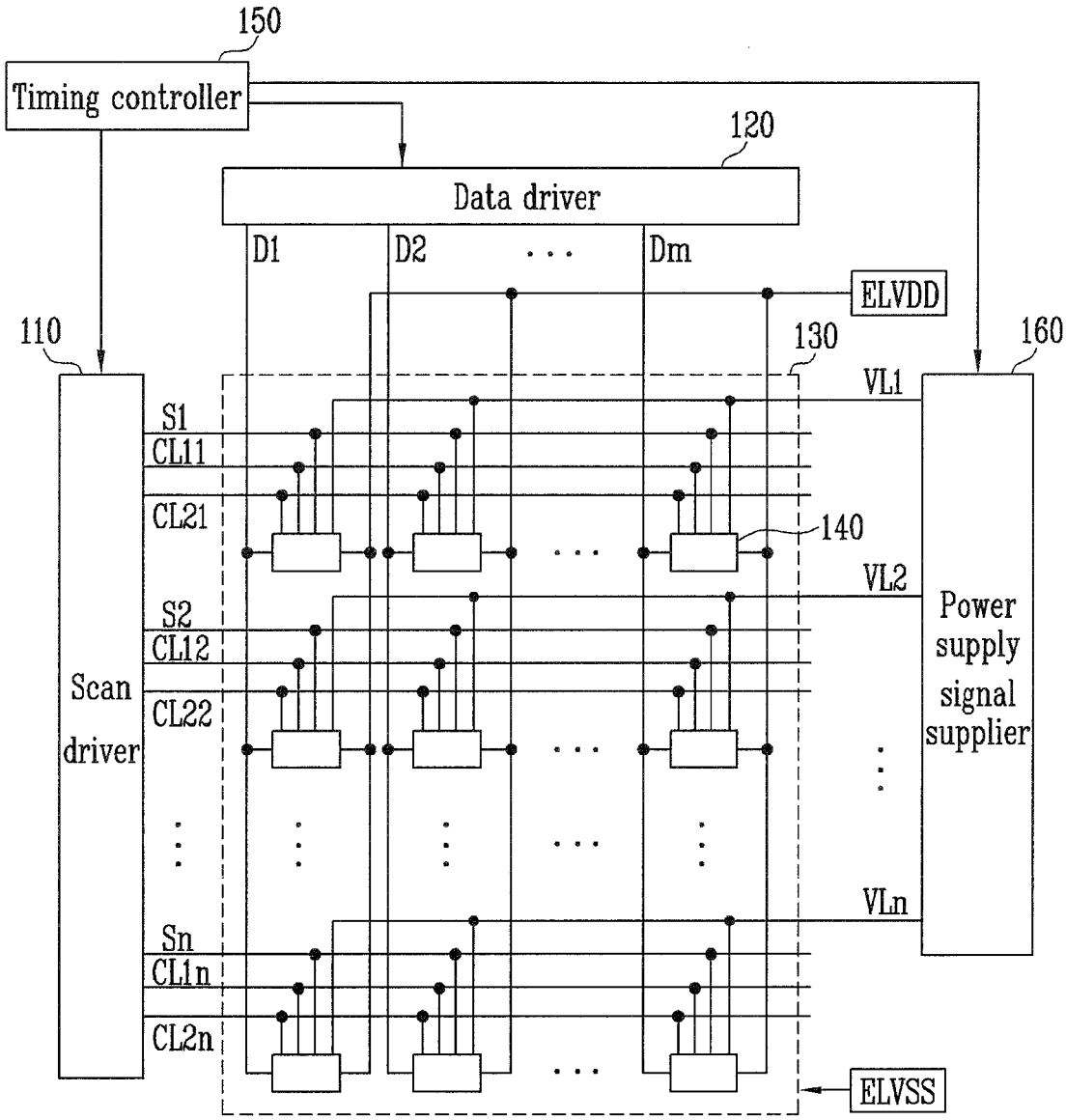
FIG. 3 illustrates an organic light emitting display according to an embodiment of the present invention.

FIG. 3 illustrates an organic light emitting display according to an embodiment of the present invention.

Referring to FIG. 3, the organic light emitting display according to the embodiment of the present invention includes a pixel unit 130, a scan driver 110, a data driver 120, a power supply signal supplier 160, and a timing controller 150. Herein, the pixel unit 130 includes pixels 140 positioned at regions partitioned by scan lines S1 to Sn, first control lines CL11 to CL1*n*, second control lines CL21 to CL2*n*, power supply lines VL1 to VLn, and data lines D1 to Dm. The scan driver 110 drives the scan lines S1 to Sn, the first control lines CL11 to CL1*n*, and the second scan lines CL21 to CL2*n*. The data driver 120 drives the data lines D1 to Dm. The power supply signal supplier 160 drives the power supply lines VL1 to VLn. The timing controller 150 controls the scan driver 110, the data driver 120, and the power supply signal supplier 160.

The scan driver 110 generates scan signals under control of the timing controller 150 to sequentially supply the generated scan signals to the scan lines S1 to Sn. The polarity of the scan signal is set so that a transistor included in the pixel 140 is turned on. For example, in the case where the transistor included in the pixel 140 is a PMOS transistor, the polarity of the scan signal is set to a low voltage.

Also, the scan driver 110 generates first control signals to sequentially supply them to the first control lines CL11 to CL1*n*, and generates second control signals to sequentially supply them to the second control lines CL21 to CL2*n*. The polarity of the first control signal is set so that the transistor included in the pixel 140 is turned off, and the polarity of the second control signal is set so that the transistor included in the pixel 140 is turned on. However, it is possible to omit the second control lines CL21 to CL2*n* according to a structure of the pixel 140. In this case, the scan driver 110 would supply only the first control signals to the first control lines CL11 to CL1*n*.

The power supply signal supplier 160 sequentially supplies power supply signals to the power supply lines VL1 to VLn. The power supply line receiving the power supply signal is set to a first voltage and the power supply line not receiving the power supply signal is set to a second voltage higher than that of the first voltage. The power supply signal supplied to an $i^{th}$ power supply line is overlapped with the scan signal supplied to an $i^{th}$ scan line and at the same time, is set with a width wider than the scan signal.

The data driver 120 generates data signals by control of the timing controller 150 to supply the generated data signals to the data lines D1 to Dm to be synchronized with the scan signals.

The timing controller 150 controls the scan driver 110, the data driver 120, and the power supply signal supplier 160. Also, the timing controller 150 transfers data supplied from the outside to the data driver 120.

The pixel unit 130 receives first and second power supplies ELVDD, ELVSS from the outside to supply them to each of the pixels 140. Each of the pixels 140 receiving the first and second power supplies ELVDD, ELVSS generates light corresponding to the data signal.

Each of these pixels 140 compensates for deterioration of an organic light emitting diode included therein, so that light in a desired brightness is maintained. To this end, each of the pixels is installed with a compensating unit compensating for the deterioration of the organic light emitting diode.

Figure 4:
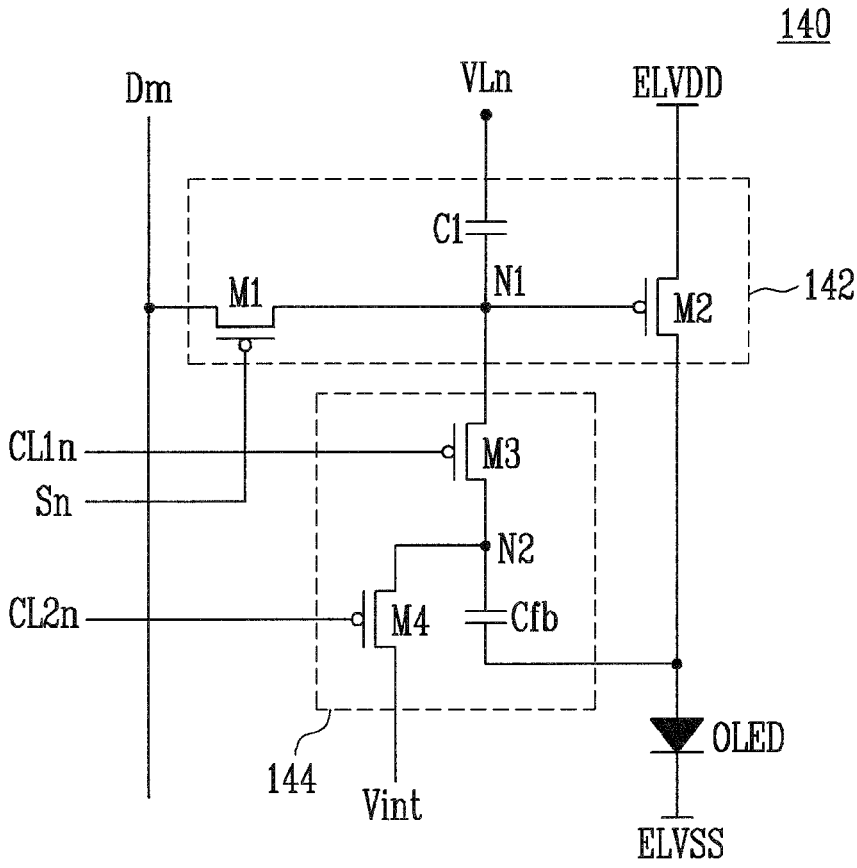
FIG. 4 is a circuit diagram showing a first embodiment of a pixel shown in FIG. 3.

FIG. 4 is a circuit diagram showing a pixel according to a first embodiment of the present invention. In FIG. 4, the pixel coupled to an $n^{th}$ scan line Sn and an $m^{th}$ data line Dm will be shown for convenience of explanation.

Referring to FIG. 4, the pixel 140 according to the first embodiment of the present invention includes an organic light emitting diode OLED, a pixel circuit 142 including a transistor M2 (i.e. a driving transistor) supplying current to the organic light emitting diode OLED, and a compensating unit 144 compensating for the deterioration of the organic light emitting diode OLED.

An anode electrode of the organic light emitting diode OLED is coupled to the pixel circuit 142, and a cathode electrode thereof is coupled to second power supply ELVSS. Such an organic light emitting diode OLED generates light in a predetermined brightness corresponding to current supplied from the transistor M2. To this end, first power supply ELVDD has a voltage value higher than that of the second power supply ELVSS.

The pixel circuit 142 supplies the current to the organic light emitting diode OLED. To this end, the pixel circuit 142 includes a transistor M1, the transistor M2, and a first capacitor C1.

A gate electrode of the transistor M1 is coupled to the scan line Sn, and a first electrode thereof is coupled to the data line Dm. A second electrode of the transistor M1 is coupled to a gate electrode (i.e., a first node N1) of the transistor M2. When the scan signal is supplied to the scan line, transistor M1 is turned on to supply the data signal supplied to the data line Dm to the first node N1.

The gate electrode of the transistor M2 is coupled to the first node N1, and a first electrode thereof is coupled to the first power supply ELVDD. A second electrode of the transistor M2 is coupled to the anode electrode of the organic light emitting diode OLED. Transistor M2 supplies current corresponding to voltage applied to the first node N1 to the organic light emitting diode OLED.

The first capacitor C1 is coupled between the first node N1 and a power supply line VLn. Such a first capacitor C1 is charged with a voltage corresponding to the data signal.

The compensating unit 144 controls the voltage of the first node N1 corresponding to the deterioration of the organic light emitting diode OLED. In other words, the compensating unit 144 controls so that as the organic light emitting diode deteriorates, the voltage of the first node N1 is lowered, thereby compensating for the deterioration of the organic light emitting diode OLED.

To this end, the compensating unit 144 includes transistor M3, feedback capacitor Cfb, and transistor M4. The transistor M3 is coupled between the first node N1 and the anode electrode of the organic light emitting diode OLED. The transistor M4 is positioned between an initialization power supply Vint and a second node N2, which is a common terminal of the transistor M3 and the feedback capacitor Cfb.

The transistor M3 is positioned between the first node N1 and the second node N2. When the first control signal is supplied, the transistor M3 is turned off to block an electrical coupling of the first node N1 and the second node N2. When the first control signal is not supplied, the transistor M3 is turned on.

The feedback capacitor Cfb is coupled between the second node N2 and the anode electrode of the organic light emitting diode OLED. Such a feedback capacitor is charged with voltage between the second node N2 and the anode electrode of the organic light emitting diode OLED.

The transistor M4 is coupled between the second node N2 and the initialization power supply Vint. When the second control signal is supplied, such a transistor M4 is turned on to keep the voltage of the second node N2 at the voltage of the initialization power supply Vint. The initialization power supply Vint used to keep the voltage of the second node N2 at a constant voltage can be set to a variety of voltages. For example, the initialization power supply Vint can be set to the same voltage as that of the first power supply EVLDD.

Figure 5:
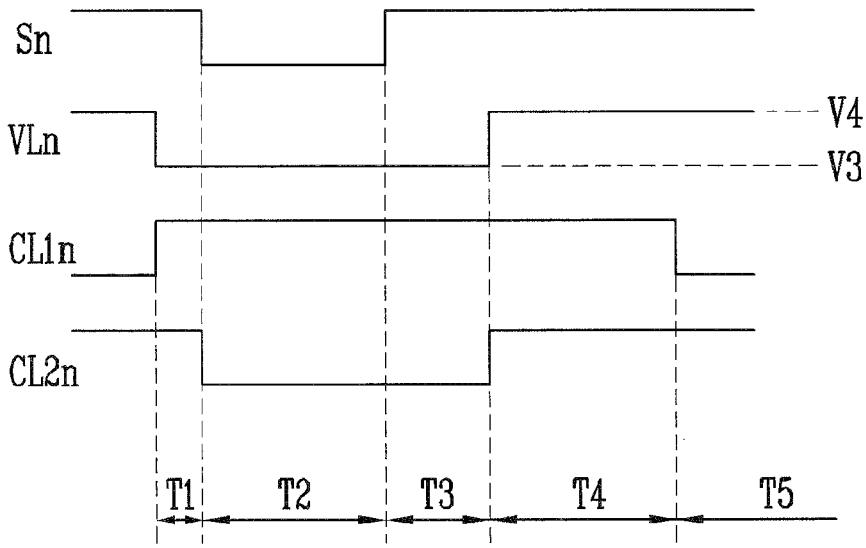
FIG. 5 is a waveform diagram showing a method of driving the pixel shown in FIG. 4.

FIG. 5 is a waveform diagram showing a driving method of the pixel shown in FIG. 4.

Referring to FIG. 5, the scan driver 110 supplies the second control signal to an $n^{th}$ second control line CL2*n* to overlap with the scan signal supplied to the $n^{th}$ scan line Sn and have a width wider than that of the scan signal. The scan driver 110 supplies the first control signal to an $n^{th}$ first control line CL1*n* to overlap with the second control signal supplied to the $n^{th}$ second control line CL2*n* and have a width wider than that of the second control signal.

An operational process will now be more fully described with reference to FIGS. 4 and 5. First, during a first period T1, the power supply signal is supplied to the power supply line VLn and at the same time, the first control signal is supplied to the first control line CL1*n*.

When the first control signal is supplied to the first control line CL1*n*, the transistor M3 is turned off. When the transistor M3 is turned off, the electrical coupling of the first node N1 and the second node N2 is blocked. The first control signal is supplied to overlap with the scan signal. Accordingly, the transistor M3 maintains a turn-off state during a period of the supply of the data signal to the first node N1.

When the power supply signal is supplied to the power supply line VLn, the voltage of the power supply line VLn drops from the voltage V4 to the voltage V3. The voltage of the first node N1 also drops corresponding to the voltage drop of the power supply line VLn by the coupling of the first capacitor C1.

When the voltage of the first node N1 drops, the current is supplied from the transistor M2 to the organic light emitting diode OLED. The voltages V3, V4 are set so that a high current can flow from the transistor M2 to the organic light emitting diode OLED. For example, the voltages V3, V4 are set so that the current higher than a maximum current capable of flowing to the organic light emitting diode corresponding to the data signal can flow.

During a second period T2, the scan signal is supplied to the scan line Sn and at the same time, the second control signal is supplied to the second control line SL2*n*.

When the second control signal is supplied to the second control line CL2*n*, the transistor M4 is turned on. When the transistor M4 is turned on, the voltage of the initialization power supply Vint is supplied to the second node N2. The second control signal is supplied to overlap with the scan signal. Accordingly, the transistor M4 maintains a turn-on state during a period of supply of the data signal to the first node N1.

When the scan signal is supplied to the scan line Sn, the transistor M1 is turned on. When the transistor M1 is turned on, the data signal supplied to the data line Dm is supplied to the first node N1. At this time, the capacitor C1 is charged with the voltage corresponding to the data signal. The transistor M2 supplies a first current corresponding to the voltage drop of the power supply line VLn and the data signal to the organic light emitting diode OLED during the second period T2.

At this time, a predetermined voltage corresponding to the first current is applied to the organic light emitting diode OLED. The feedback capacitor Cfb is charged with a voltage corresponding to difference between the voltage applied to the organic light emitting diode OLED corresponding to the first current and the voltage of the initialization power supply Vint.

The data signal supplied during the second period T2 corresponds to a grayscale higher than a grayscale wanted to really display (i.e., in order to emit more light emitting current) such that current corresponding to a normal grayscale can be supplied in the case where the voltage of the power supply line VLn later rises.

During a third period T3, the supply of the scan signal to the scan line Sn is suspended. When the supply of the scan line to the scan line Sn is suspended, the transistor M1 is turned off. During this period, the feedback capacitor Cfb is continuously charged with the voltage corresponding to the voltage applied to the organic light emitting diode OLED corresponding to the first current.

During a fourth period T4, the supply of the second control signal to the second control line CL2*n* and the supply of the power supply signal to the power supply line VLn are suspended.

When the supply of the power supply signal to the power supply line VLn is suspended, the voltage of the power supply line VLn rises from the voltage V3 to the voltage V4. At this time, since the first node N1 is set in a floating state, the voltage of the first node also rises corresponding to the voltage rise of the power supply line VLn. In this case, the transistor M2 supplies a second current lower than the first current corresponding to the first node N1 to the organic light emitting diode OLED.

When the supply of the second control signal to the second control line CL2*n* is suspended, the transistor M4 is turned off. That is, the transistor M4 is set in the turn-off state when the second current is supplied to the organic light emitting diode OLED. When the transistor M4 is turned off, the second node N2 is set to the floating state.

The organic light emitting diode OLED receiving the second current from the transistor M2 is applied with a voltage corresponding to the second current. Since the second current is lower than the first current, the voltage applied to the organic light emitting diode OLED during the fourth period T4 is set to a voltage lower than the voltage applied thereto during the third period T3.

At this time, the voltage of the second node N2 set in the floating state is also changed corresponding to the voltage applied to the organic light emitting diode OLED. The voltage of the second node N2 is changed as provided in Equation 1 below.

$$V_{N2}=V\text{int}-(V\text{oled1}-V\text{oled2}) \qquad \text{Equation 1}$$

In Equation 1, Voled1 means the voltage applied to the organic light emitting diode OLED corresponding to the first current, and Voled2 means the voltage applied to the organic light emitting diode OLED corresponding to the second current.

During a fifth period T5, the supply of the first control signal to the first control line CL1*n* is suspended. When the supply of the first control signal is suspended, the transistor M3 is turned on. When the transistor M3 is turned on, the first node N1 and the second node N2 are electrically coupled. At this time, electrical charges stored in the first capacitor C1 and the feedback capacitor Cfb are shared so that the voltage of the first node N1 is changed as provided in Equation 2 below.

$$V_{N1}=\{C1\times V\text{data}+Cfb\times(V\text{int}-(V\text{oled1}-V\text{oled2}))\}/(C1+Cfb) \qquad \text{Equation 2}$$

In Equation 2, Vdata means the voltage corresponding to the data signal.

In the case where the organic light emitting diode deteriorates, the resistance of the organic light emitting diode is increased so that the voltage values of Voled1–Voled2 are increased. In this case, a voltage drop width of the first node N1 is increased by Equation 2. That is, in accordance with the present invention, in the case where the organic light emitting diode OLED deteriorates, the current flowing from the transistor M2 corresponding to the same data signal is increased, thereby making it possible to compensate for the deterioration of the organic light emitting diode OLED.

Figure 6:
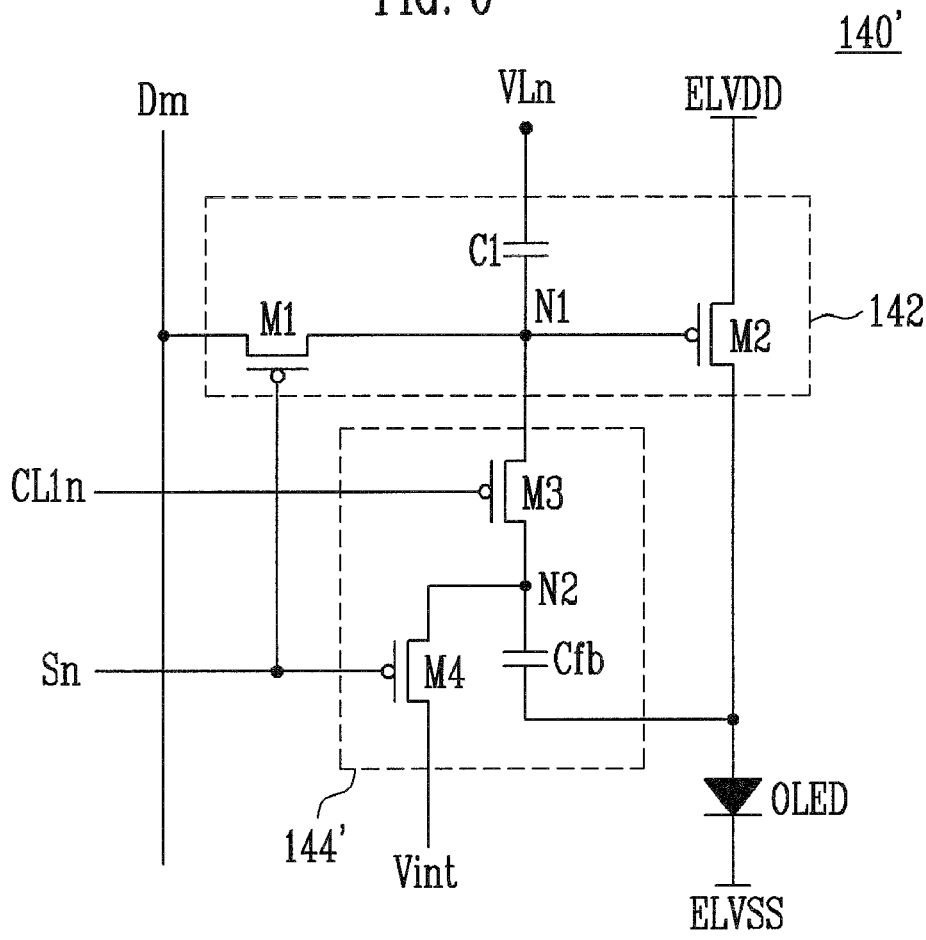
FIG. 6 is a circuit diagram showing a second embodiment of a pixel shown in FIG. 3.

FIG. 6 is a circuit diagram showing a pixel according to a second embodiment of the present invention. In FIG. 6, a detailed description with respect to the same constitution as FIG. 4 will be omitted.

Referring to FIG. 6, the pixel 140' according to the second embodiment of the present invention includes an organic light emitting diode OLED, a pixel circuit 142 including a transistor M2 supplying current to the organic light emitting diode OLED, and a compensating unit 144' compensating for the deterioration of the organic light emitting diode OLED.

In the compensating unit 144' according to the second embodiment of the present invention, the gate electrode of the transistor M4 is coupled to the scan line Sn. The transistor M4 is turned on when the scan signal is supplied to the scan line, and it is turned off when the scan signal is not supplied thereto.

Figure 7:
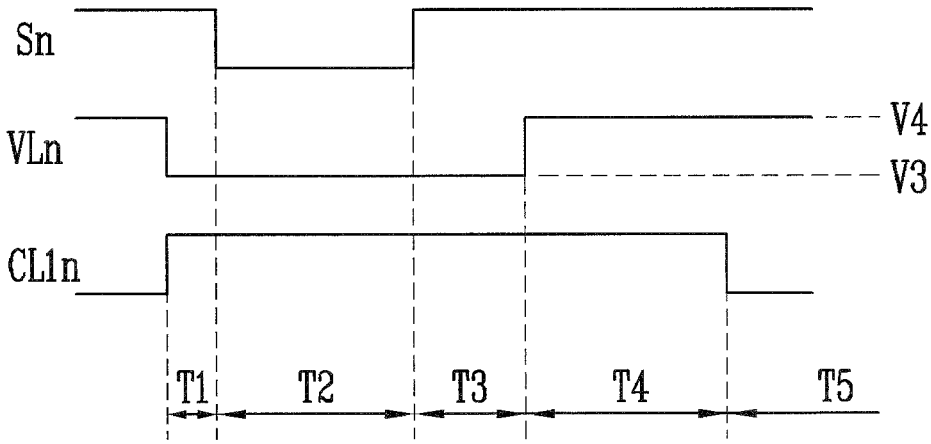
FIG. 7 is a waveform diagram showing a method of driving the pixel shown in FIG. 6.

FIG. 7 is a waveform diagram showing a method of driving the pixel shown in FIG. 6.

An operational process will be described in detail with reference to FIGS. 6 and 7. First, during the first period T1, the power supply signal is supplied to the power supply line VLn and at the same time, the first control signal is supplied to the first control line CL1*n*.

When the first control signal is supplied to the first control line CL1*n*, the transistor M3 is turned off. When the transistor M3 is turned off, the electrical coupling of the first node N1 and the second node N2 is blocked.

When the power supply signal is supplied to the power supply line VLn, the voltage of the power supply line VLn drops from the voltage V4 to the voltage V3. At this time, the voltage of the first node N1 also drops corresponding to the voltage drop of the power supply line VLn by the coupling of the first capacitor C1.

When the voltage of the first node N1 drops, the current is supplied from the transistor M2 to the organic light emitting diode OLED. The voltages V3, V4 are set so that a high current can flow from the transistor M2 to the organic light emitting diode OLED.

During the second period T2, the scan signal is supplied to the scan line Sn. When the scan signal is supplied to the scan line Sn, the transistor M1 and the transistor M4 are turned on. When the transistor M4 is turned on, the voltage of the initialization power supply Vint is supplied to the second node N2.

When the transistor M1 is turned on, the data signal supplied to the data line Dm is supplied to the first node N1. At this time, the first capacitor is charged with the voltage corresponding to the data signal. The transistor M2 supplies the first current corresponding to the voltage drop of the power supply line VLn and the data signal to the organic light emitting diode OLED during the second period T2.

At this time, a predetermined voltage corresponding to the first current is applied to the organic light emitting diode OLED. The feedback capacitor Cfb is charged with the voltage corresponding to the difference between the voltage applied to the organic light emitting diode OLED corresponding to the first current and the voltage of the initialization power supply Vint.

The data signal supplied during the second period T2 corresponds to the grayscale higher than the grayscale wanted to really display (i.e. in order to emit more light emitting current) such that the current corresponding to the normal grayscale can be supplied in the case where the voltage of the power supply line VLn later rises.

During the third period T3, the supply of the scan signal to the scan line Sn is suspended. When the supply of the scan signal to the scan line Sn is suspended, the transistor M1 and the transistor M4 are turned off. When the transistor M4 is turned off, the second node N2 is set in the floating state. When the second node N2 is set in the floating state, the feedback capacitor Cfb maintains the voltage charged during the first period T1.

During the fourth period T4, the supply of the power supply signal to the power supply line VLn is suspended.

When the supply of the power supply signal to the power supply line VLn is suspended, the voltage rises from the voltage V3 to the voltage V4. At this time, since the first node N1 is set in the floating state, the voltage of the first node N1 also rises corresponding to the voltage rise of the power supply line VLn. In this case, the transistor M2 supplies the second current lower than the first current corresponding to the first node N1 to the organic light emitting diode OLED.

The organic light emitting diode OLED receiving the second current from the transistor M2 is applied with a voltage corresponding to the second current. Since the second current is lower than the first current, the voltage applied to the organic light emitting diode OLED during the fourth period T4 is set to the voltage lower than the voltage applied thereto during the third period T3.

At this time, the voltage of the second node N2 set in the floating state is also changed corresponding to the voltage applied to the organic light emitting diode OLED. The voltage of the second node N2 is changed according to Equation 1 above.

During the fifth period T5, the supply of the first control signal to the first control line CL1*n* is suspended. When the supply of the first control signal is suspended, the transistor M3 is turned on. When the transistor M3 is turned on, the first node N1 and the second node N2 are electrically coupled. At this time, the electrical charges stored in the first capacitor C1 and the feedback capacitor Cfb are shared so that the voltage of the first node N1 is changed as in Equation 2. That is, in accordance with the present invention, in the case where the organic light emitting diode OLED deteriorates, the current flowing from the transistor M2 corresponding to the same data signal is increased, thereby making it possible to compensate for the deterioration of the organic light emitting diode OLED.

Figure 8:
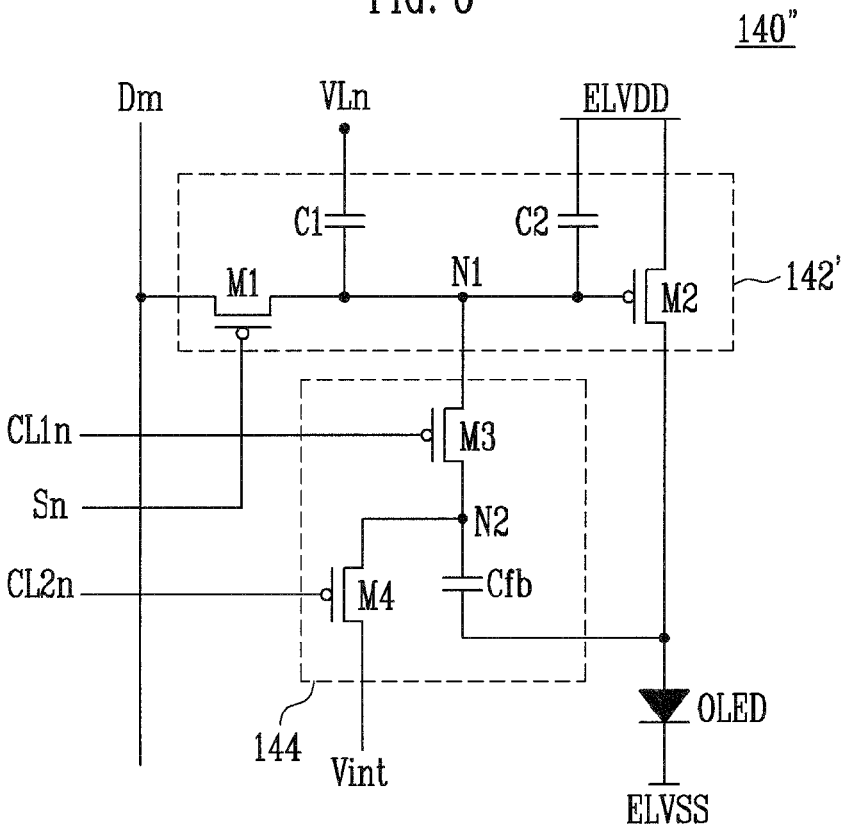
FIG. 8 is a circuit diagram showing a third embodiment of a pixel shown in FIG. 3.

FIG. 8 illustrates a pixel according to a third embodiment of the present invention. In FIG. 8, a detailed description with respect to the same constitution as FIG. 4 will be omitted.

Referring to FIG. 8, the pixel 140" according to third embodiment of the present invention includes an organic light emitting diode OLED, a pixel circuit 142' including a transistor M2 supplying current to the organic light emitting diode OLED, and a compensating unit 144 compensating for the deterioration of the organic light emitting diode OLED.

The pixel circuit 142' according to the third embodiment of the present invention further includes a second capacitor C2 positioned between the first power supply ELVDD and the first node N1. Such a second capacitor C2 is charged with the voltage corresponding to the data signal. That is, the pixel 140" according to the third embodiment of the present invention changes the voltage of the first node N1 using the first capacitor C1 and charges the voltage corresponding to the data signal using the second capacitor C2. In this case, the first capacitor is also additionally charged with the voltage corresponding to the data signal.

The pixel 140" shown in FIG. 8 is set so that a configuration and an operational process thereof are same as those of the pixel 140 shown in FIG. 4, except for the second capacitor C2.

Figure 9:
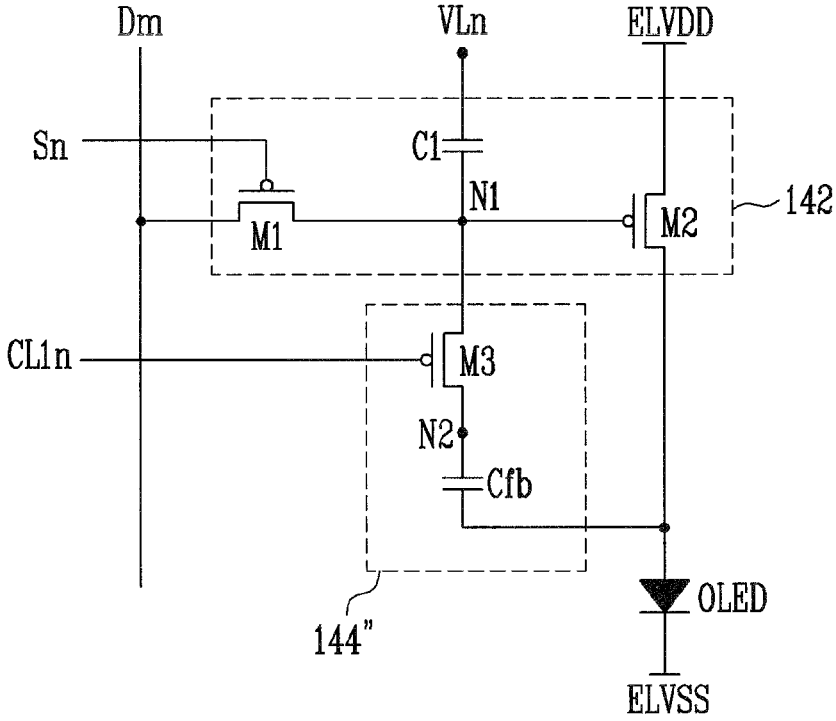
FIG. 9 is a circuit diagram showing a fourth embodiment of a pixel shown in FIG. 3.

FIG. 9 illustrates a pixel according to a fourth embodiment of the present invention. In FIG. 9, a detailed description with respect to the same constitution as FIG. 4 will be omitted.

Referring to FIG. 9, the pixel 140'" according to the fourth embodiment of the present invention includes an organic light emitting diode OLED, a pixel circuit 142 including a transistor M2 supplying current to the organic light emitting diode OLED, and a compensating unit 144" compensating for the deterioration of the organic light emitting diode OLED.

The compensating unit 144" includes a transistor M3 and the feedback capacitor Cfb positioned between the first node and the anode electrode of the organic light emitting diode OLED.

The transistor M3 is positioned between the first node N1 and the second node N2. When the first control signal is supplied to the first control line CL1*n*, transistor M3 is turned off to block the electrical coupling of the first node N1 and the second node N2. When the first control signal is not supplied, the transistor M3 is turned on.

The feedback capacitor Cfb is coupled between the second node N2 and the anode electrode of the organic light emitting diode. Such a feedback capacitor is charged with the voltage between the second node N2 and the anode electrode of the organic light emitting diode OLED.

Figure 10:
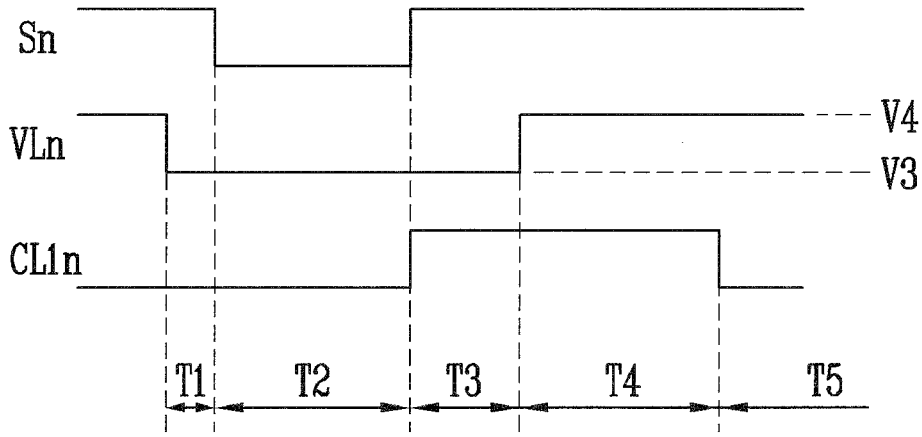
FIG. 10 is a waveform diagram showing a method of driving the pixel shown in FIG. 9.

FIG. 10 is a waveform diagram showing a driving method of the pixel shown in FIG. 9.

Referring to FIG. 10, after the supply of the scan signal to the $n^{th}$ control line Sn is suspended, the scan driver 110 supplies the first control signal to the $n^{th}$ first control line to have a width the same as or wider than the scan signal. In this case, the transistor M3 maintains the turn-on state during the period of the supply of the data signal to the first node N1, and is turned off after the data signal is supplied to the first node N1.

An operational process will now be described more fully with reference to FIGS. 9 and 10. First, during the first period T1, the power supply signal is supplied to the power supply line VLn. When the power supply signal is supplied to the power supply line VLn, the voltage of the power supply line VLn drops from the voltage V4 to the voltage V3. At this time, the voltage of the first node N1 also drops corresponding to the voltage drop of the power supply line VLn by the coupling of the first capacitor C1.

When the voltage of the first node N1 drops, the current is supplied from the transistor M2 to the organic light emitting diode OLED.

During the second period T2, the scan signal is supplied to the scan line Sn. When the scan signal is supplied to the scan line Sn, the transistor M1 is turned on. When the transistor M1 is turned on, the data signal supplied to the data line Dm is supplied to the first node N1. At this time, the first capacitor is charged with the voltage corresponding to the data signal. The transistor M2 supplies the first current corresponding to the voltage drop of the power supply line VLn and the data signal to the organic light emitting diode OLED during the second period T2.

At this time, a predetermined voltage corresponding to the first current is applied to the organic light emitting diode OLED. The feedback capacitor Cfb is charged with the voltage applied to the organic light emitting diode OLED corresponding to the first current and the voltage applied to the first node N1.

The data signal supplied during the second period T2 is supplied to correspond to the grayscale higher than the grayscale wanted to really display (i.e., in order to emit more light emitting current) such that the current corresponding to the normal grayscale can be supplied in the case where the voltage of the power supply line VLn later rises.

During the third period T3, the supply of the scan signal to the scan line Sn is suspended and at the same time, the first control signal is supplied to the first control line CL1*n*. When the supply of the scan signal to the scan line Sn is suspended, the transistor M1 is turned off.

When the first control signal is supplied to the first control line CL1*n*, the transistor M3 is turned off. In this case, the second node N2 is set in the floating state. At this time, the feedback capacitor Cfb maintains the voltage charged during the second period T2.

During the fourth period T4, the supply of the power supply signal to the power supply line VLn is suspended. When the supply of the power supply signal to the power supply line VLn is suspended, the voltage of the power supply line VLn rises from the voltage V3 to the voltage V4. At this time, since the first node N1 is set in the floating state, the voltage of the first node N1 also rises corresponding to the voltage rise of the power supply line VLn. In this case, the transistor M2 supplies the second current lower than the first current corresponding to the first node N1 to the organic light emitting diode OLED.

The organic light emitting diode OLED receiving the second current from the transistor M2 is applied with the voltage corresponding to the second current. Since the second current is lower than the first current, the voltage applied to the organic light emitting diode OLED is set to a voltage lower than the case of the first current. At this time, the voltage of the second node N2 set in the floating state is also changed corresponding to the voltage applied to the organic light emitting diode OLED.

During the fifth period T5, the supply of the first control signal to the first control line CL1*n* is suspended. When the supply of the first control signal is suspended, the transistor M3 is turned on. When the transistor M3 is turned on, the first node N1 and the second node N2 are electrically coupled. At this time, the charges stored in the first capacitor C1 and the feedback capacitor Cfb are shared so that the voltage of the first node N1 is changed.

The voltage change of the first node N1 is determined by the voltage corresponding to the difference of Voled1−Voled2. In other words, as the voltage corresponding to the difference of the Voled1−Voled2 becomes large, a voltage drop width of the first node N1 increases, thereby making it possible to compensate for the deterioration of the organic light emitting diode OLED.

Figure 11:
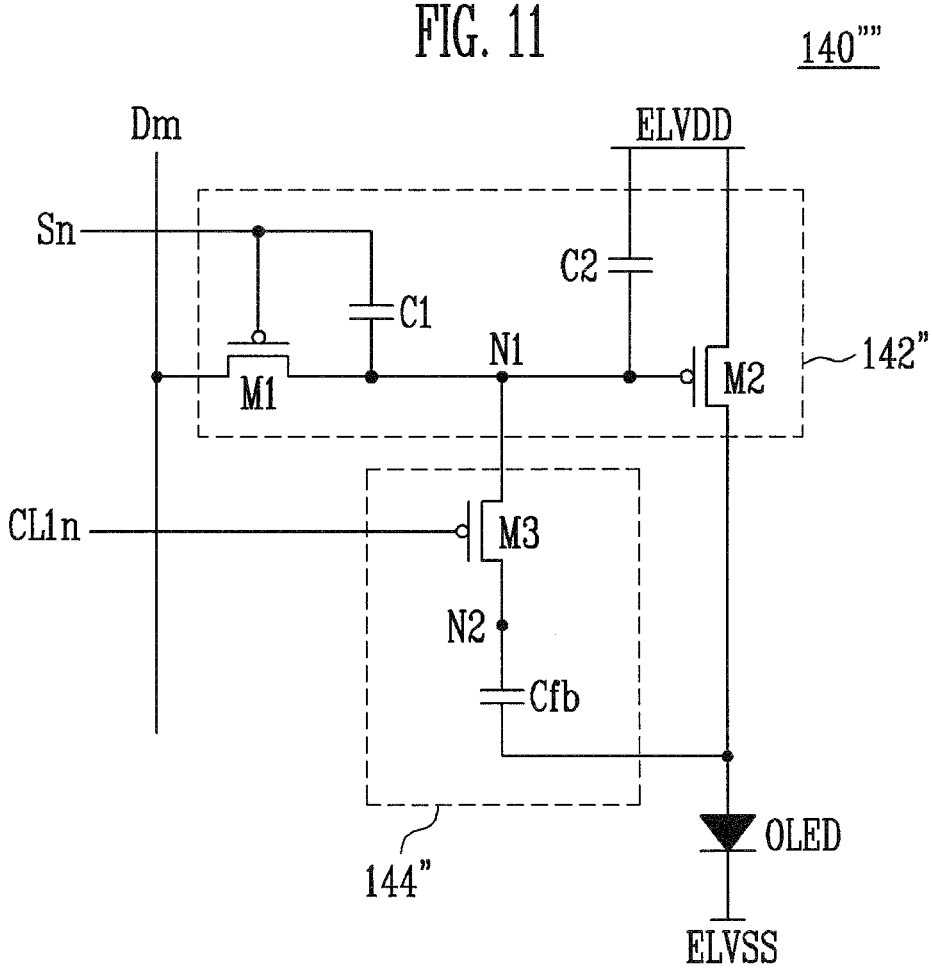
FIG. 11 is a circuit diagram showing a fifth embodiment of a pixel shown in FIG. 3.

FIG. 11 is a view showing a pixel according to a fifth embodiment of the present invention. In FIG. 11, a detailed description with respect to the same constitution as FIG. 9 will be omitted.

Referring to FIG. 11, the pixel 140"" according to the fifth embodiment of the present invention includes the organic light emitting diode OLED, a pixel circuit 142" including the transistor M2 supplying the current to the organic light emitting diode OLED, and the compensating unit 144" compensating for the deterioration of the organic light emitting diode OLED.

The pixel circuit 142" further includes a second capacitor C2 positioned between the first power supply ELVDD and the first node N1. That is, the pixel 140"" according to the fifth embodiment of the present invention changes the voltage of the first node N1 using the first capacitor C1 and charges the voltage corresponding to the data signal using the second capacitor C2. In this case, the first capacitor is also additionally charged with the voltage corresponding to the data signal.

In the fifth embodiment of the present invention, the first capacitor C1 is positioned between the scan line Sn and the first node N1. In this case, when the scan signal is supplied, the voltage of the scan line Sn is set to the voltage V3, and when the scan signal is not supplied, it is set to the voltage V4.

Figure 12:
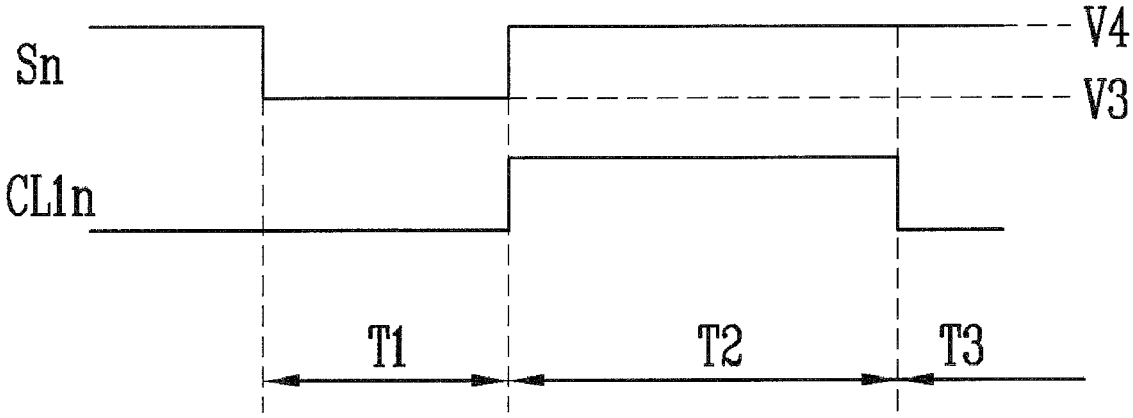
FIG. 12 is a waveform diagram showing a method of driving the pixel shown in FIG. 11.

FIG. 12 is a waveform diagram showing a driving method of the pixel shown in FIG. 11.

An operational process will now now be described in more detail with reference to FIGS. 11 and 12. First, during the first period T1, the scan signal is supplied to the scan line Sn. When the scan signal is supplied to the scan line Sn, the transistor M1 is turned on. At this time, the data signal from the data line Dm is supplied to the first node N1. When the scan signal is supplied to the scan line Sn, the voltage of the scan line Sn drops from the voltage V4 to the voltage V3. At this time, the voltage of the first node N1 also drops corresponding to the voltage drop of the scan line Sn by the coupling the first capacitor C1.

In this case, the transistor M2 supplies the first current corresponding to the voltage drop of the scan line Sn and the data signal to the organic light emitting diode OLED during the first period T1.

At this time, a predetermined voltage corresponding to the first current is applied to the organic light emitting diode OLED. The feedback capacitor Cfb is charged with the voltage corresponding to the difference between the voltage applied to the organic light emitting diode OLED corresponding to the first current and the voltage applied to the first node N1.

During the second period T2, the supply of the scan signal to the scan line Sn is suspended and at the same time, the first control signal is supplied to the first control line CL1*n*.

When the first control signal is supplied to the first control line CL1*n*, the transistor M3 is turned off. At this time, the second node N2 is set in the floating state.

When the supply of the scan signal to the scan line Sn is suspended, the transistor M1 is turned off. When the supply of the scan signal to the scan line Sn is suspended, the voltage of the scan line Sn rises from the voltage V3 to the voltage V4. At this time, since the first node is set in the floating state, the voltage of the first node N1 also rises corresponding to the voltage rise of the power supply line VLn. In this case, the transistor M2 supplies the second current lower than the first current corresponding to the first node N1 to the organic light emitting diode OLED.

The organic light emitting diode OLED receiving the second current from the transistor M2 is applied with a voltage corresponding to the second current. Since the second current is lower than the first current, the voltage applied to the organic light emitting diode OLED is set to the voltage lower than the voltage corresponding to the second current. At this time, the voltage of the second node N1 set in the floating state is also changed corresponding to the voltage applied to the organic light emitting diode OLED.

During the third period T3, the supply of the first control signal to the first control line CL1*n* is suspended. When the supply of the first control signal is suspended, the transistor M3 is turned on. When the transistor M3 is turned on, the first node N1 and the second node N2 are electrically coupled. At this time, the charges stored in the first capacitor C1 and the feedback capacitor Cfb are shared so that the voltage of the first node N1 is changed.

The voltage change of the first node N1 is determined by the voltage corresponding to the difference of Voled1−Voled2. In other words, as the voltage corresponding to the difference of the Voled1−Voled2 becomes large, the voltage drop width of the first node N1 increases, thereby making it possible to compensate for the deterioration of the organic light emitting diode OLED.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode;

a pixel circuit coupled to the organic light emitting diode, the pixel circuit having a first transistor for controlling current supplied from a first power supply to the organic light emitting diode corresponding to a data signal; and a compensating unit, coupled to the pixel circuit and the organic light emitting diode, for controlling a voltage of a gate electrode of the first transistor to compensate for deterioration of the organic light emitting diode, wherein the compensating unit comprises:

a second transistor, coupled between the gate electrode of the first transistor and the organic light emitting diode and comprising a gate electrode, a first electrode, and a second electrode, for being turned off during a period of a supply of the data signal to the pixel circuit, and a feedback capacitor comprising a first electrode and a second electrode, the first electrode of the feedback capacitor being directly connected to the second electrode of the second transistor and the second electrode of the feedback capacitor being directly connected to the organic light emitting diode.

2. The pixel as claimed in claim 1, wherein the compensating unit further comprises a third transistor coupled between a common terminal of the second transistor and the feedback capacitor and an initialization power supply.

3. The pixel as claimed in claim 2, wherein the third transistor maintains a turn-on state during the period of the supply of the data signal to the pixel circuit.

4. The pixel as claimed in claim 2, wherein the initialization power supply is set to a same voltage as a voltage of the first power supply.

5. The pixel as claimed in claim 2, wherein the pixel circuit further comprises:

a fourth transistor, coupled between a data line and the first transistor, for being turned on during the period of the supply of the data signal; and a first capacitor, coupled between a power supply line for maintaining a first voltage during a partial period including the period of the supply of the data signal, for maintaining a second voltage higher than the first voltage during an other period, and the gate electrode of the first transistor.

6. The pixel as claimed in claim 5, wherein the pixel circuit further comprises a second capacitor coupled between the gate electrode of the first transistor and the first power supply.

7. An organic light emitting display comprising:

a scan driver for sequentially supplying scan signals to scan lines and sequentially supplying first control signals to first control lines;

a data driver for supplying data signals to data lines;

a power supply signal supplier for sequentially supplying power supply signals to power supply lines;

pixels positioned at crossing points of the scan lines and the data lines, wherein each of the pixels positioned at an $i^{th}$ (i is a natural number) horizontal line comprises:

an organic light emitting diode;

a pixel circuit including a first transistor for controlling an amount of current supplied from a first power supply to the organic light emitting diode; and a compensating unit, coupled to the pixel circuit and the organic light emitting diode, including a second transistor, coupled between a gate electrode of the first transistor and the organic light emitting diode and comprising a gate electrode, a first electrode, and a second electrode, for being turned off during a period of a supply of a scan signal to an $i^{th}$ scan line from among the scan lines, and a feedback capacitor comprising a first electrode and a second electrode, the first electrode of the feedback capacitor being directly connected to the second electrode of the second transistor and the second electrode of the feedback capacitor being directly connected to the organic light emitting diode.

8. An organic light emitting display comprising:

a scan driver for sequentially supplying scan signals to scan lines and sequentially supplying first control signals to first control lines;

a data driver for supplying data signals to data lines;

a power supply signal supplier for sequentially supplying power supply signals to power supply lines;

pixels positioned at crossing points of the scan lines and the data lines, wherein each of the pixels positioned at an $i^{th}$ (i is a natural number) horizontal line comprises:

an organic light emitting diode;

a pixel circuit including a first transistor for controlling an amount of current supplied from a first power supply to the organic light emitting diode; and a compensating unit, coupled to the pixel circuit and the organic light emitting diode, including a second transistor, coupled between a gate electrode of the first transistor and the organic light emitting, for being turned off during a period of a supply of a scan signal to an $i^{th}$ scan line from among the scan lines, and a feedback capacitor coupled between the second transistor and the organic light emitting diode, wherein the scan driver supplies a first control signal to an $i^{th}$ first control line from among the first control lines to overlap with the scan signal supplied to the $i^{th}$ scan line and at the same time, have a width wider than that of the scan signal.

9. The organic light emitting display as claimed in claim 8, wherein the second transistor is turned off when the first control signal is supplied.

10. The organic light emitting display as claimed in claim 7, further including a third transistor, coupled between a common terminal of the second transistor and the feedback capacitor and an initialization power supply, for being turned on when the scan signal is supplied to the $i^{th}$ scan line.

11. The organic light emitting display as claimed in claim 10, wherein the initialization power supply is set to the same value as that of the first power supply.

12. The organic light emitting display as claimed in claim 7, wherein the scan driver sequentially supplies second control signals to second control lines.

13. An organic light emitting display comprising:

a scan driver for sequentially supplying scan signals to scan lines and sequentially supplying first control signals to first control lines;

a data driver for supplying data signals to data lines;

a power supply signal supplier for sequentially supplying power supply signals to power supply lines;

pixels positioned at crossing points of the scan lines and the data lines, wherein each of the pixels positioned at an $i^{th}$ (i is a natural number) horizontal line comprises:

an organic light emitting diode;

a pixel circuit including a first transistor for controlling an amount of current supplied from a first power supply to the organic light emitting diode; and a compensating unit, coupled to the pixel circuit and the organic light emitting diode, including a second transistor, coupled between a gate electrode of the first transistor and the organic light emitting, for being turned off during a period of a supply of a scan signal to an $i^{th}$ scan line from among the scan lines, and a feedback capacitor coupled between the second transistor and the organic light emitting diode, wherein the scan driver sequentially supplies second control signals to second control lines, and the scan driver supplies a second control signal to an $i^{th}$ second control line from among the second control lines to overlap with the scan signal supplied to the scan line and at the same time, have a width wider than that of the scan signal.

14. The organic light emitting display as claimed in claim 13, further comprising a third transistor, coupled between a common terminal of the second transistor and the feedback capacitor and an initialization power supply, for being turned on when the second control signal is supplied to the $i^{th}$ second control line.

15. The organic light emitting display as claimed in claim 7, wherein the pixel circuit further comprises:

a fourth transistor, coupled between a data line from among the data lines and the first transistor, for being turned on when the scan signal is supplied to the $i^{th}$ scan line; and a first capacitor coupled between an $i^{th}$ power supply line for receiving a power supply signal from among the power supply signals during a partial period including a period of a supply of a data signal to the data line, and the gate electrode of the first transistor.

16. The organic light emitting display as claimed in claim 15, wherein a voltage of the $i^{th}$ power supply line is maintained as a first voltage when the power supply signal is supplied, and the voltage of the $i^{th}$ power supply line is maintained as a second voltage higher than the first voltage during an other period.

17. The organic light emitting display as claimed in claim 15, wherein the pixel circuit further comprises a second capacitor coupled between the gate electrode of the first transistor and the first power supply.

* * * * *